US008024895B2

(12) United States Patent
Hall et al.

(10) Patent No.: US 8,024,895 B2
(45) Date of Patent: Sep. 27, 2011

(54) DEVICE FOR RAISING AND LOWERING A LIGHTING MAST

(75) Inventors: Geoffrey Hall, Teversal Village (GB); Alan John Jenvey, Kirkby-in-Ashfield (GB)

(73) Assignee: Abacus Holdings Limited, Nottinghamshire (GB)

( * ) Notice: Subject to any disclaimer, the term of this patent is extended or adjusted under 35 U.S.C. 154(b) by 825 days.

(21) Appl. No.: 11/720,155

(22) PCT Filed: Nov. 28, 2005

(86) PCT No.: PCT/GB2005/004528

§ 371 (c)(1),
(2), (4) Date: Mar. 5, 2008

(87) PCT Pub. No.: WO2006/059073

PCT Pub. Date: Jun. 8, 2006

(65) Prior Publication Data

US 2008/0250727 A1 Oct. 16, 2008

(30) Foreign Application Priority Data

Nov. 30, 2004 (GB) ..... 0426206.9

(51) Int. Cl.
*B66C 23/34* (2006.01)

(52) U.S. Cl. ..... 52/123.1; 52/116; 52/745.17

(58) Field of Classification Search ..... 52/123.1, 52/116–119, 745.17
See application file for complete search history.

(56) References Cited

U.S. PATENT DOCUMENTS 4,020,606 A 5/1977 Pratt
4,592,177 A 6/1986 Pratt
4,942,537 A * 7/1990 Verry ..... 703/1

FOREIGN PATENT DOCUMENTS

| | | |
|---|---|---|
| DE | 2319877 | 11/1973 |
| GB | 1460025 | 12/1976 |
| GB | 2239463 A | 7/1991 |
| GB | 2349653 A | 11/2000 |
| WO | 84/02372 | 6/1984 |

OTHER PUBLICATIONS

International Preliminary Report on Patentability dated Dec. 5, 2006.
International Search Report from EPO dated Feb. 8, 2006.
Patents Act 1977: Search Report under Section 17(5) dated Mar. 23, 2005 from the corresponding British Application No. GB0426206.9.

* cited by examiner

*Primary Examiner* — Jeanette E Chapman
*Assistant Examiner* — Daniel Kenny
(74) *Attorney, Agent, or Firm* — Young Basile

(57) ABSTRACT

An arrangement for the raising and lowering of a mast, which includes an upper mast portion and base, which upper mast portion is rotatable about a horizontal pivot axis, located in the base of the mast is described. The arrangement includes (i) docking device for restraining the upper mast portion against rotation; (ii) attachment device for attaching a drive device for driving the docking device between a first engaged configuration wherein the upper mast portion is restrained against rotation and a second disengaged configuration wherein the upper mast portion is free to rotate and (iii) locking device selectable via an intermediate unlocked configuration between a first locked configuration wherein the docking device is engaged and a second unlocked configuration wherein the docking device is disengaged and is characterized in that the locking means is controllable remotely to allow automatic operation of the raising and lowering sequence.

6 Claims, 12 Drawing Sheets

DEVICE FOR RAISING AND LOWERING A LIGHTING MAST

BACKGROUND OF THE INVENTION

The present invention relates to an improved arrangement for the raising and lowering of masts, in particular lighting masts, which require to be raised and lowered for repair and routine maintenance The present invention further relates to an improved method for the raising and lowering of a mast, in particular a lighting mast.

In the development of lighting systems, (for example those used in the lighting of locations such as road systems, car parks and sports stadia), there has been a continuous requirement for increased height and size of lighting installations, leading to lighting masts having a greater cross-section and increased weight.

Currently available systems for raising and lowering masts of this type, for example the systems described in GB Patent No 2 349 653 are manually operated and controlled, rather than automatic, and are suitable for use with the previously used smaller systems, but are not ideally suited for the raising and lowering of the larger systems, because of the need for manual intervention by an operator working in close proximity to the base of the mast.

It is an object of the present invention to provide an arrangement for the raising and lowering of a mast, in particular a lighting mast, in which the above disadvantages are reduced or substantially obviated.

It is a further object of the present invention to provide a method for the raising and lowering of a mast, in particular a lighting mast, in which the above disadvantages are reduced or substantially obviated.

SUMMARY OF THE INVENTION

The present invention provides an arrangement for the raising and lowering of a mast, which comprises an upper mast portion and a base which upper mast portion is rotatable about a horizontal pivot axis located in the base of the mast, which arrangement comprises (i) docking means selectively engageable for restraining the upper mast portion against rotation, (ii) attachment means for attaching drive means for driving the docking means between a first engaged configuration wherein the upper mast portion is restrained against rotation and a second disengaged configuration wherein the upper mast portion is free to rotate, and (iii) locking means, selectable via an intermediate unlocked configuration between a first locked configuration in which the docking means is engaged and a second locked configuration in which the docking means is disengaged, characterised in that the locking means is controllable remotely to allow automatic operation of the raising and lowering sequence.

A preferred embodiment of the arrangement according to the invention further comprises sensors for sensing the vertical alignment of the upper mast portion and/or the configuration of the locking means and/or the configuration of the docking means and/or the proximity of the upper mast portion to the ground (in the lowered position).

A further preferred embodiment of the arrangement according to the invention comprises drive means for driving the docking means preferably in the form of hydraulic rams, which attach to the attachment means. The drive means for driving the docking means are preferably adapted also to drive the locking means.

In a particularly preferred embodiment of the arrangement according to the invention, the locking means is located in the base of the mast and provides the horizontal axis about which the upper mast portion is rotatable.

A particularly preferred form of locking means is described and claimed in the applicant's co-pending GB Patent Application No. 0426208.5.

The arrangement according to the invention is preferably provided with a manual override to allow controlled raising and lowering of the mast in the event of a failure of the automatic system.

The present invention further provides a method for the raising and lowering of a mast comprising an upper mast portion and a base which upper mast portion is rotatable about a horizontal pivot axis located in the base of the mast, in which an arrangement comprising (i) docking means selectively engageable for restraining the upper mast portion against rotation, (ii) attachment means for attaching drive means for driving the docking means between a first engaged configuration wherein the upper mast portion is restrained against rotation and a second disengaged configuration wherein the upper mast portion is free to rotate, and (iii) locking means, selectable via an intermediate unlocked configuration between a first locked configuration in which the docking means is engaged and a second locked configuration in which the docking means is disengaged, is operated remotely according to a sequence of steps comprising (a) confirming that the upper mast portion is raised in the vertical position that the docking means is in the first engaged configuration and that the locking means is in the first locked configuration;

(b) releasing the locking means into the intermediate configuration and confirming that it is released;

(c) driving the docking means into the second disengaged configuration and confirming that it is disengaged;

(d) engaging the locking means in the second locked configuration and confirming that it is locked;

(e) lowering the upper mast portion;

(f) raising the upper mast portion into the vertical position and confirming that it is raised;

(g) releasing the locking means into the intermediate configuration and confirming that it is released;

(h) driving the docking means into the first engaged configuration and confirming that it is engaged; and (i) engaging the locking means in the first locked configuration and confirming that it is locked.

BRIEF DESCRIPTION OF THE DRAWINGS

An arrangement according to the invention for the raising and lowering of a mast, and a method for its operation will now be described with reference to the accompanying drawings, in which.

DETAILED DESCRIPTION

Figure 1:
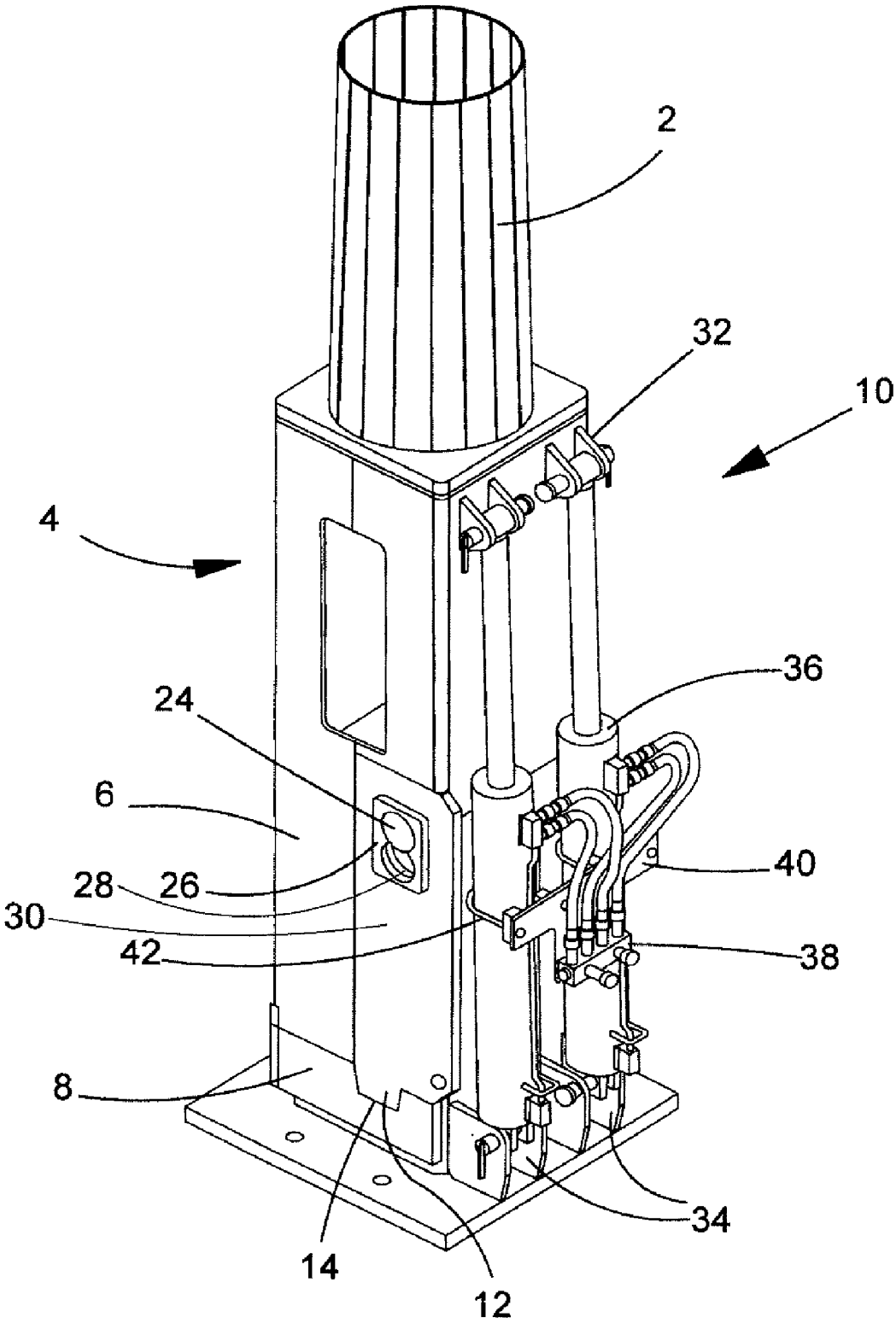
FIG. 1 is a perspective view of a mast (upper mast portion truncated) in the raised, docked and locked position, with hydraulic lift rams attached.

As can be seen from FIG. 1, a mast shown generally at 10 comprises an upper mast portion 2 and a base portion 4. The upper mast portion 2 is in the form of a hollow tapering cylinder and is shown truncated in the drawings.

The base portion 4 comprises an upper base portion 6 and a lower base portion 8. The upper base portion 6 is in the form of a substantially hollow square section box. The upper mast portion 2 extends into the upper base portion 6 and is secured thereto. The lower base portion 8 is secured to the ground (not shown). A docking latch 12 is formed at the lower end of the upper base portion 6, for engagement with a co-operating notch 14 in the upper end of the lower base portion 8. A horizontal pivot axis 16 extends through the upper base portion 6 and terminates at each end in a cam ram 18, each of which cam rams 18 comprises a cylinder 20, a shaft 22 which extends through the cylinder 20 and is slideable therein and a cam plate 24 mounted on a first end of the shaft 22. The second end of the shaft 22 projects through an aperture in the free end of the cylinder 20. One external end face only of one cam plate 24 is visible in FIG. 1.

A chock plate 26, having an aperture 28 in the form of a figure of eight, is provided on a side wall 30 of the upper base portion 6. A similar chock plate 26 is located on the opposite sidewall of the upper base portion 6 in alignment with the first chock plate 26.

Each circular portion of the figure of eight aperture 28 has an internal diameter corresponding to the diameter of the cam plate 24.

In the position shown in FIG. 1, the cam plate 24 of the cam ram 18 engages in the upper circular portion of the figure of eight aperture 28.

The neck portion of the aperture 28 is sized so as to allow the shaft 22 of the cam ram 18 to pass freely between the circular portions of the cam ram 18.

Upper U-shaped mounting brackets 32 and lower mounting brackets 34 are located on the upper base portion 6 and lower base portion 8 respectively, for receiving lift ram cylinders 36. The left ram cylinders 36 are supplied in a manner known per se by a manifold 38 mounted on a bracket 40 secured to the cylinders 36 by means of yokes 42.

In FIG. 1, the hydraulic ram cylinders 36 are shown in a partially extended configuration with the mast in a raised, docked and locked position.

Figure 2B:
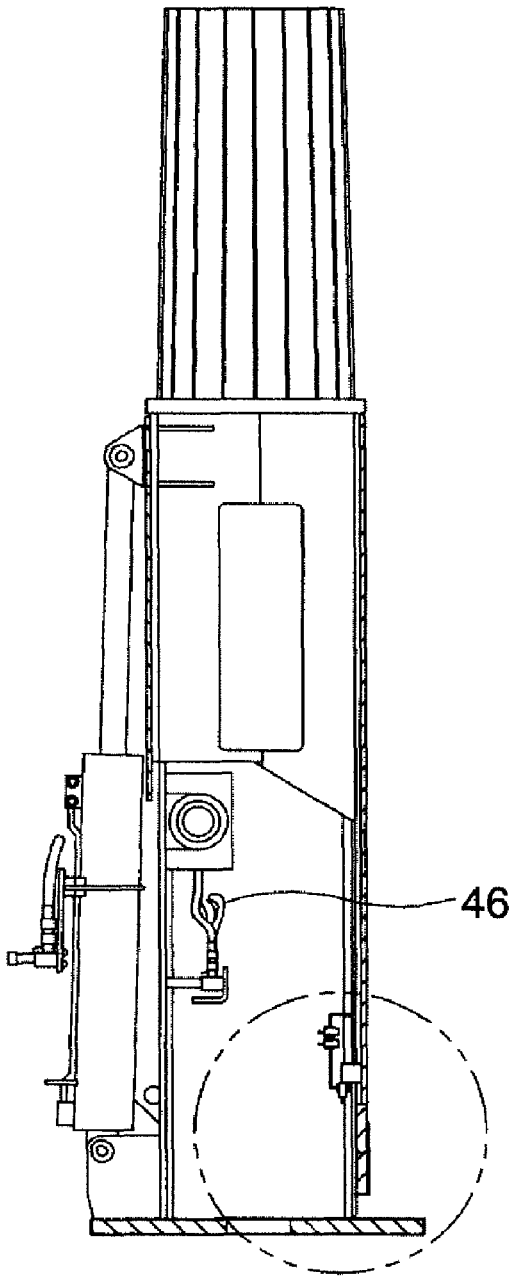
FIG. 2*b* is a section on the line B-B of FIG. 2*a;*
Figure 2A:
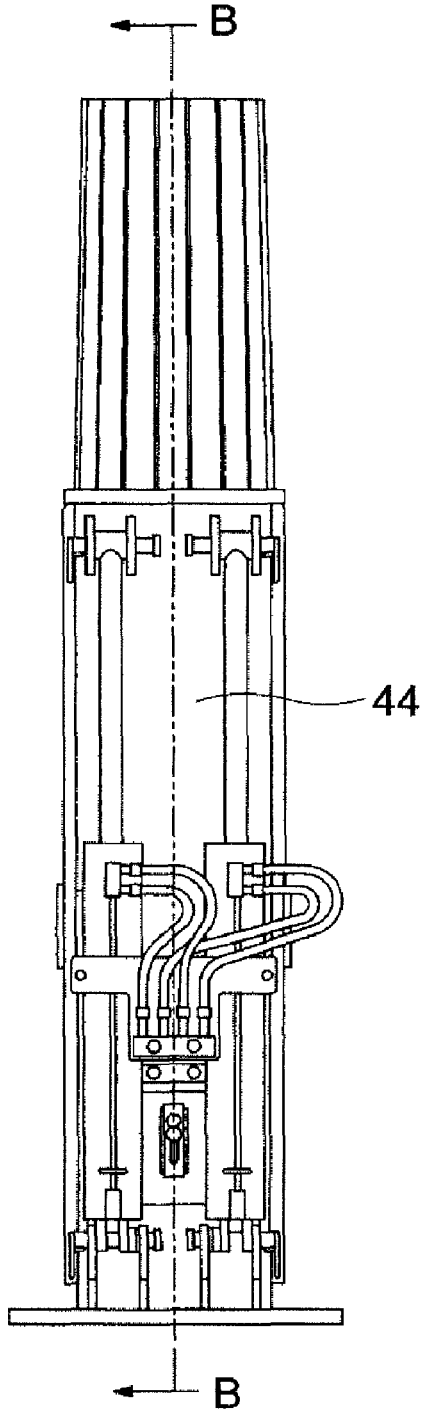
FIG. 2*a* is a view of the attachment face of a mast of FIG. 1 in the raised, docked and locked position, with hydraulic lift rams attached.

FIG. 2*a* is a view of the mast of FIG. 1 in the same configuration, but showing the attachment face 44 of the upper base portion 6.

A second manifold 46, for supply to the cam ram 18 is provided.

Figure 2D:
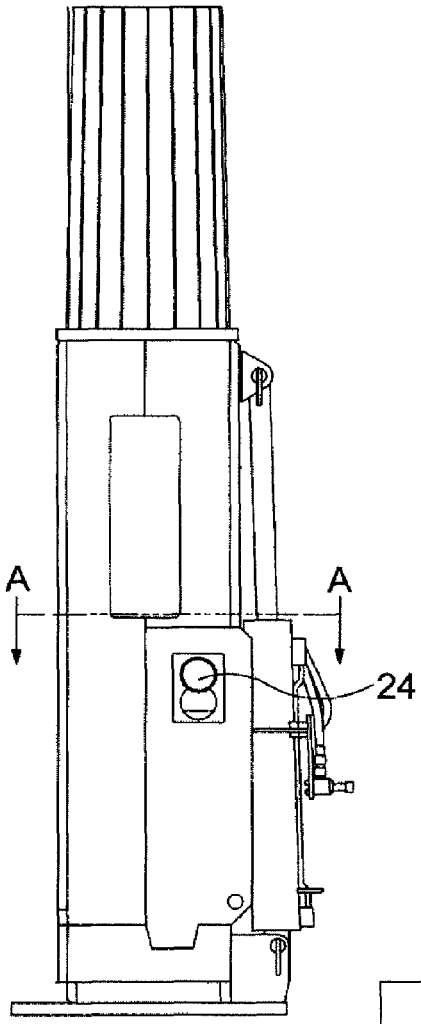
FIG. 2*d* is a side view of the mast of FIG. 2*a;*
Figure 2C:
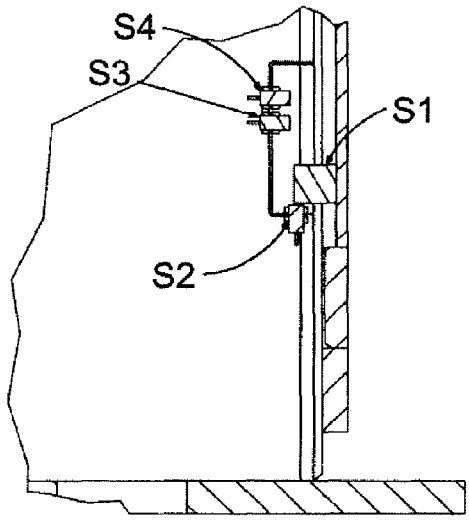
FIG. 2*c* is an enlarged view of the region C of FIG. 2*b;*
Figure 2E:
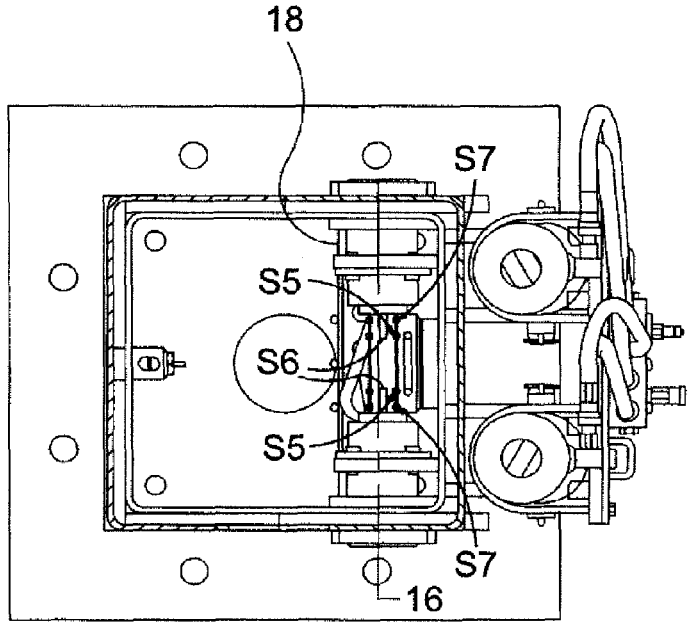
FIG. 2*e* is a section on the line A-A of FIG. 2*d;*

As can be seen from FIGS. 2*c* and 2*e*, the mast is provided with a plurality of sensors S1 to S8, which have the following functions:

Sensors S1 and S2 together sense the start of the extension of the lift rams 36 and full closure of these rams;

Sensors S1 and S3 together sense the vertical alignment of the mast 10;

Sensors S1 and S4 together sense the full extension of the lift rams 36 and the start of closure of these rams;

Sensors S5, S6 and S7 together sense the extension and closure of the cam rams 18;

Sensors S1, S2 and S4 together sense the engagement/disengagement of the docking latch 12 relative to the notch 14 and Sensor S8 senses the proximity to the ground of the lowered mast.

Figure 3B:
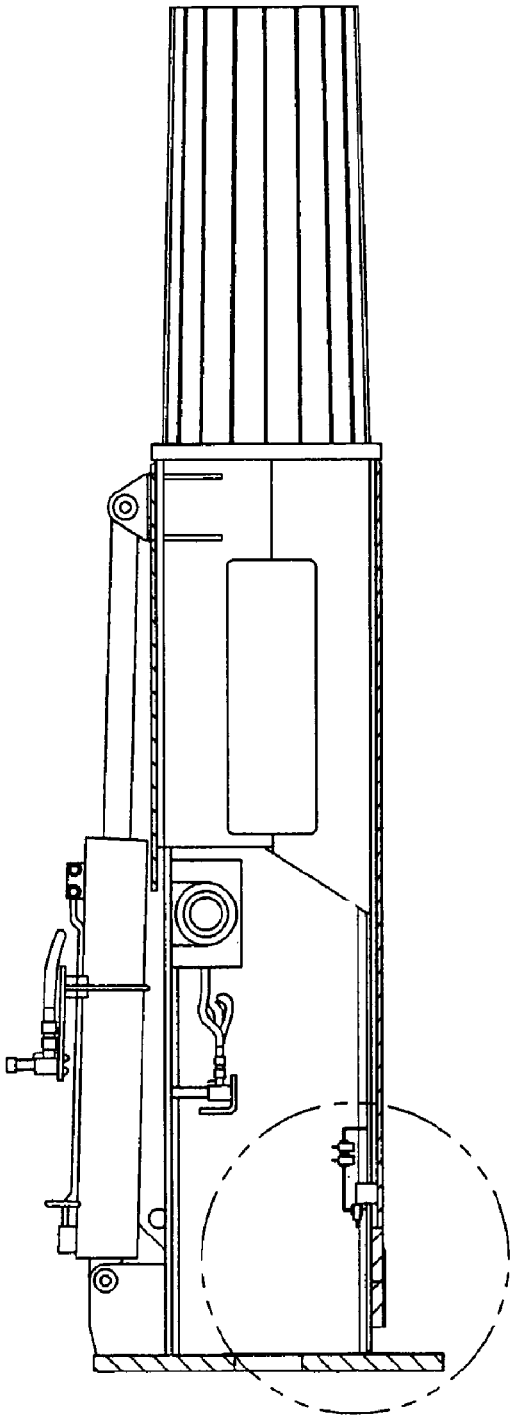
FIGS. 3*a* to 3*e* are views corresponding to FIGS. 2*a* to 2*e* in the raised, docked and unlocked position.
Figure 3A:
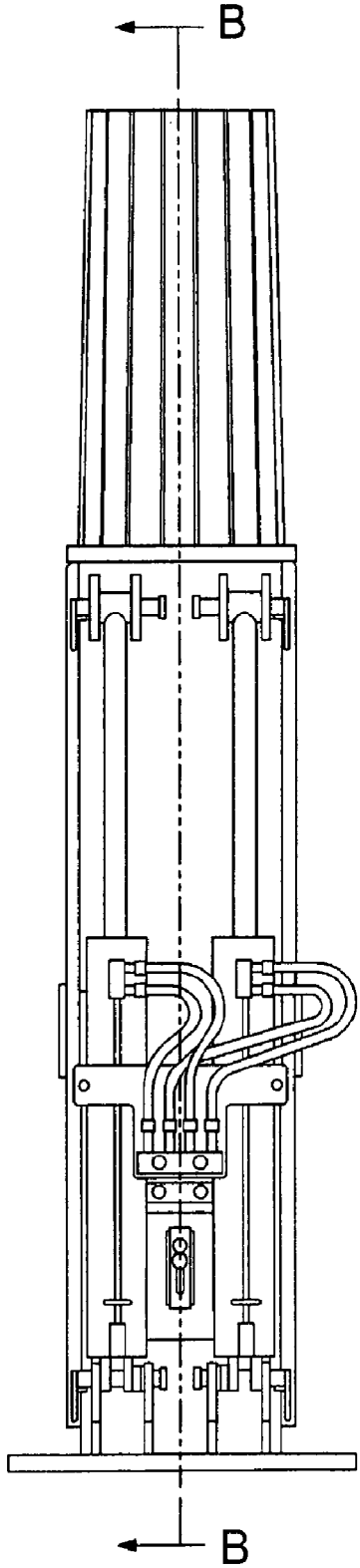
Figure 3D:
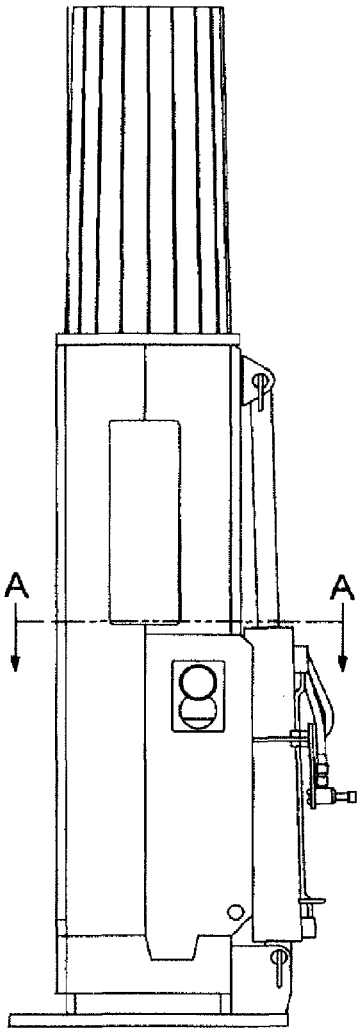
Figure 3C:
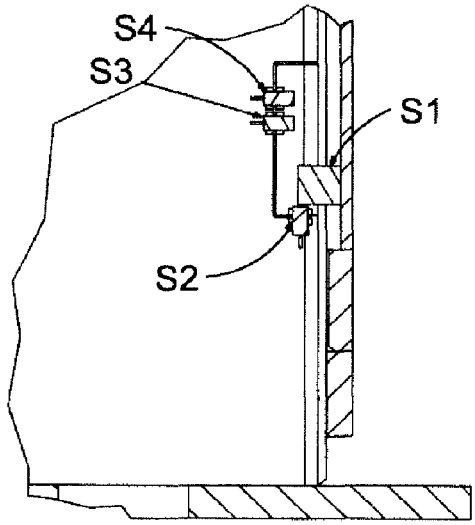
Figure 3E:
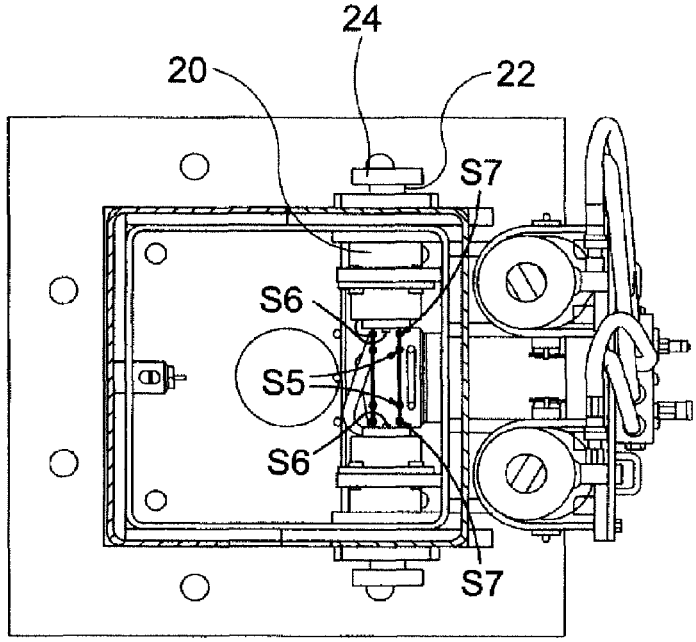
Figure 4B:
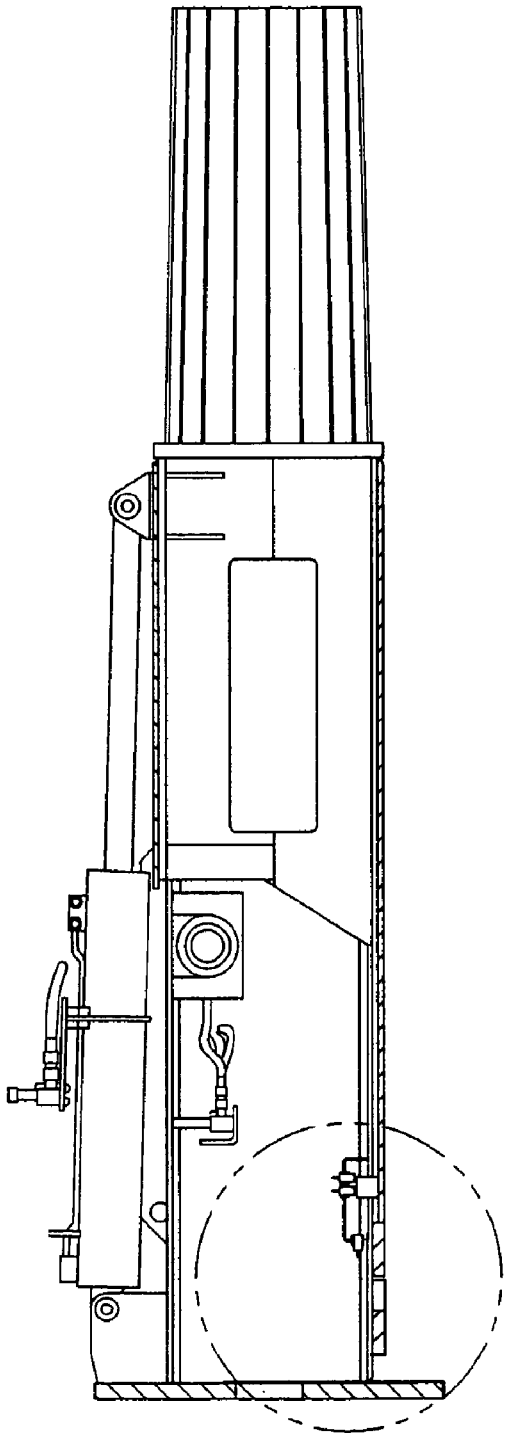
FIGS. 4*a* to 4*e* are views corresponding to FIGS. 2*a* to 2*e* in the raised, undocked and unlocked position.
Figure 4A:
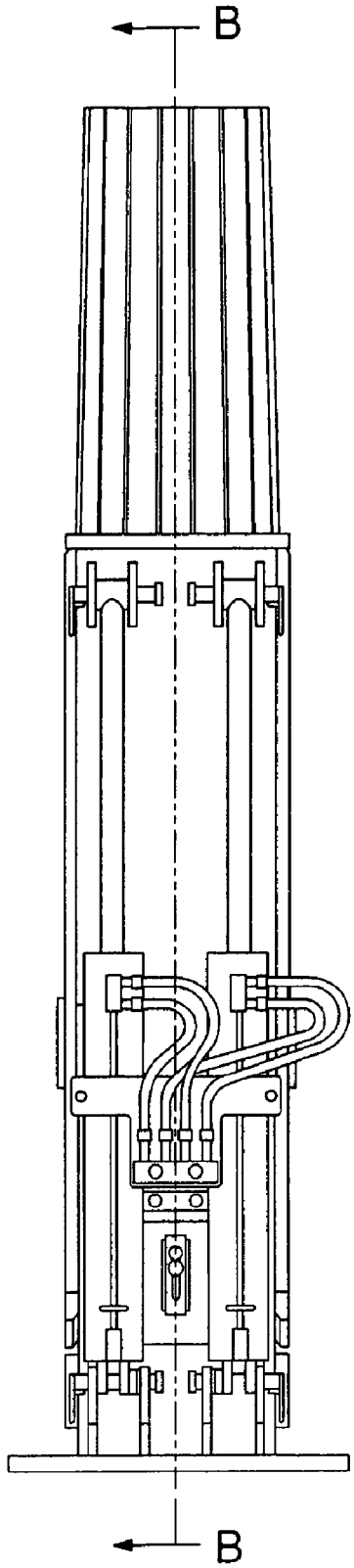
Figure 4D:
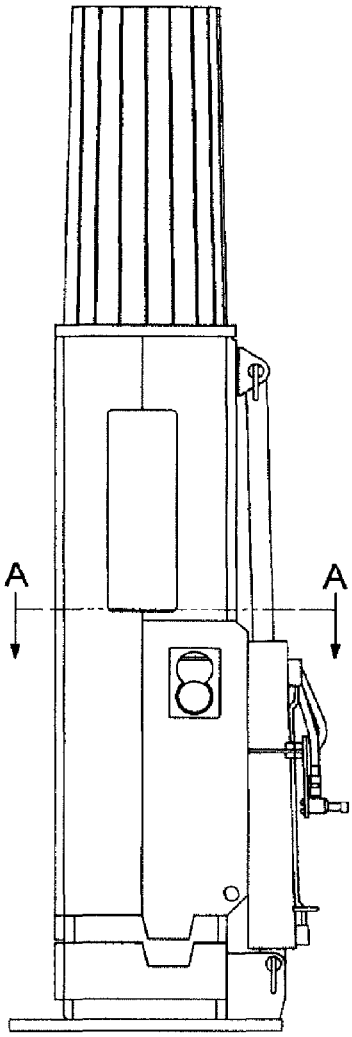
Figure 4C:
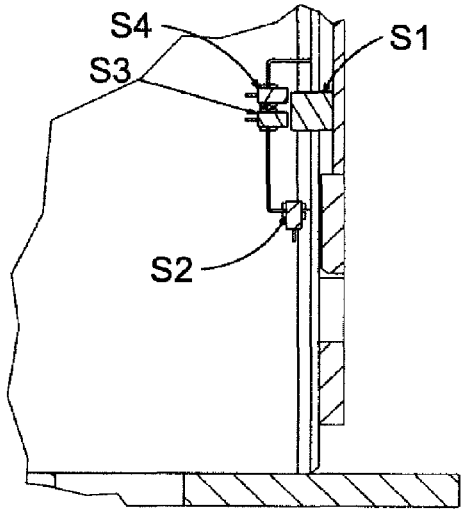
Figure 4E:
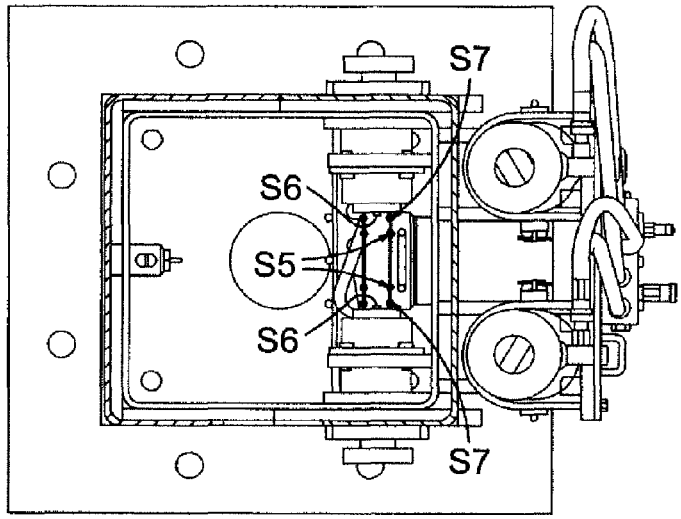
Figure 5B:
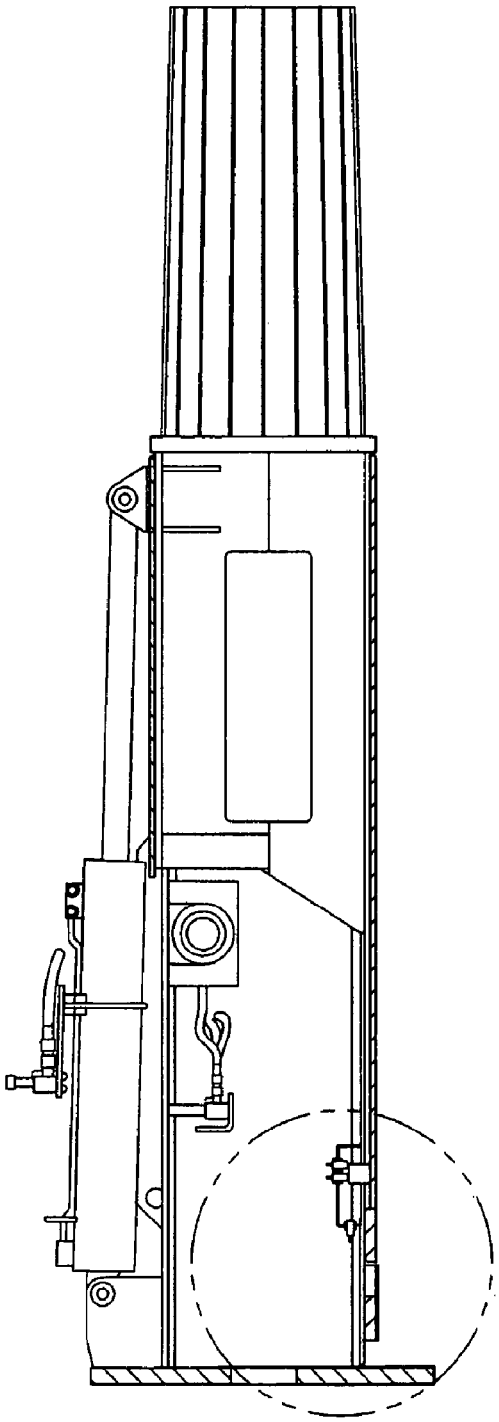
FIGS. 5*a* to 5*e* are views corresponding to FIGS. 2*a* to 2*e* in the raised, undocked and locked position.
Figure 5A:
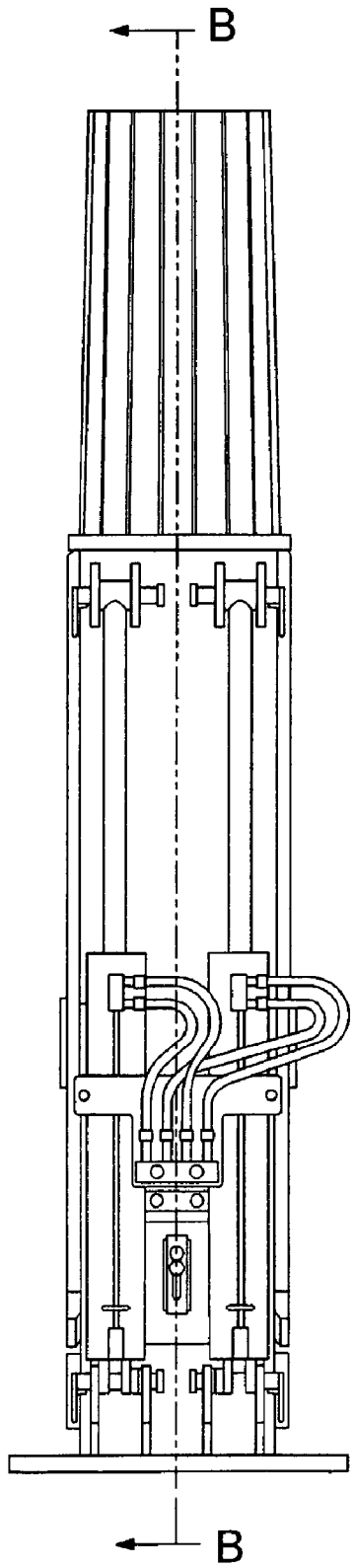
Figure 5D:
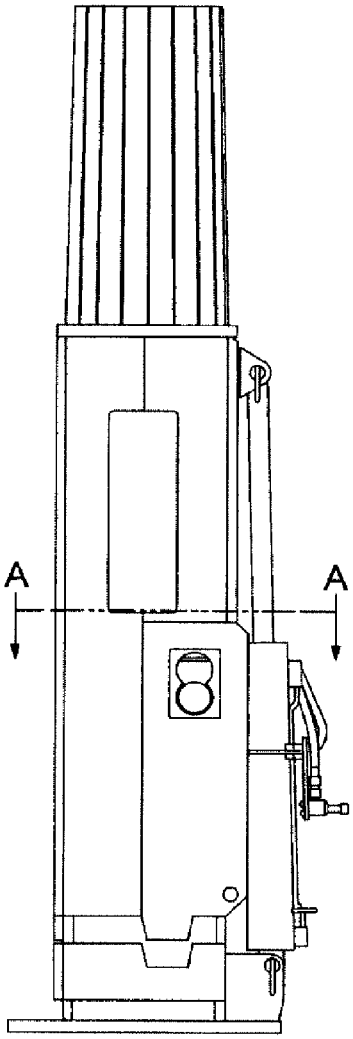
Figure 5C:
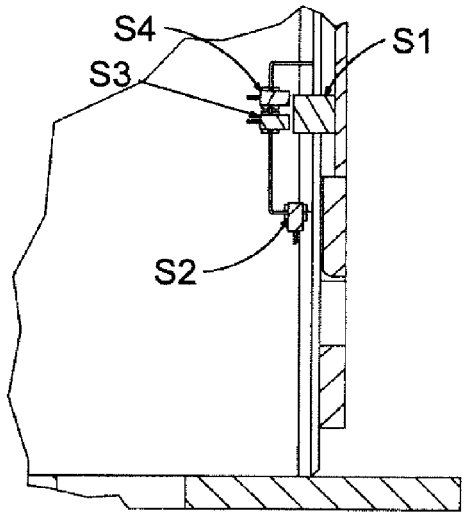
Figure 5E:
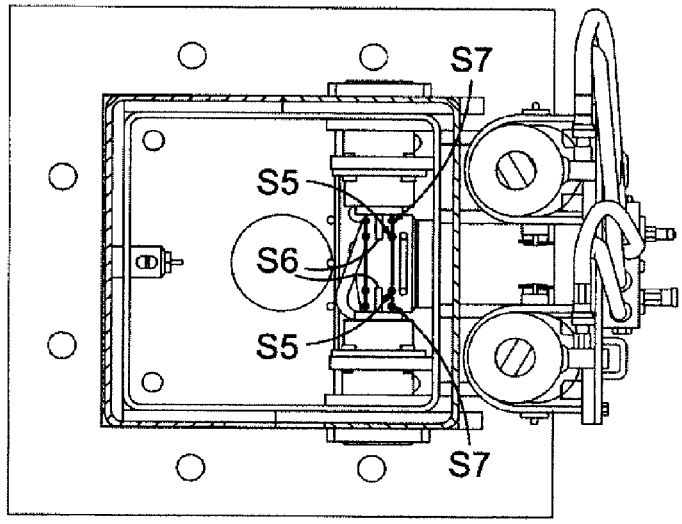
Figure 6C:
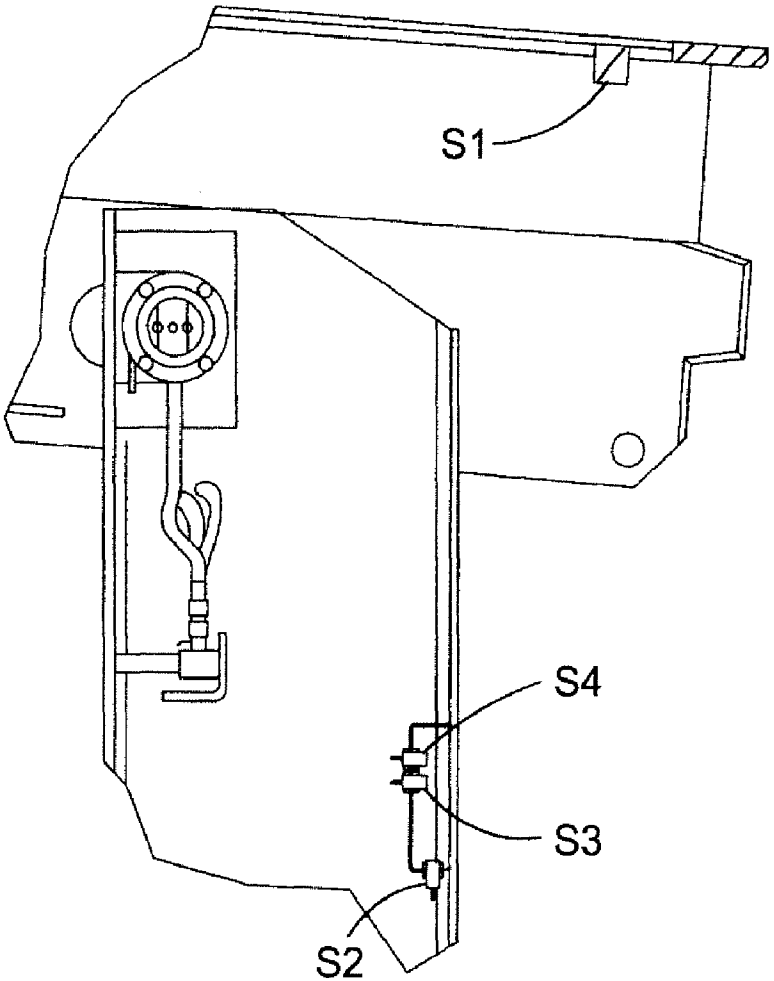
FIGS. 6*a* to 6*e* are views corresponding to FIGS. 2*a* to 2*e* in the lowered, undocked and unlocked position.
Figure 6A:
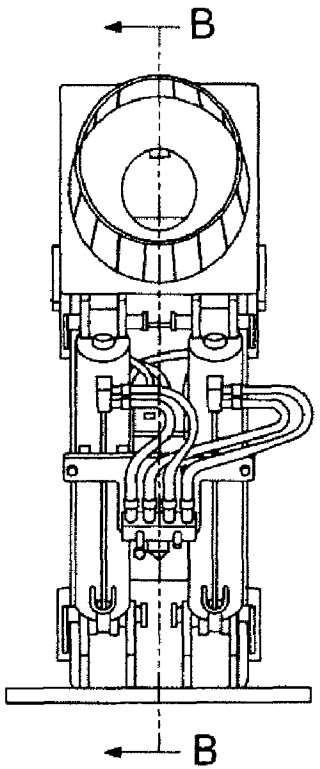
Figure 6B:
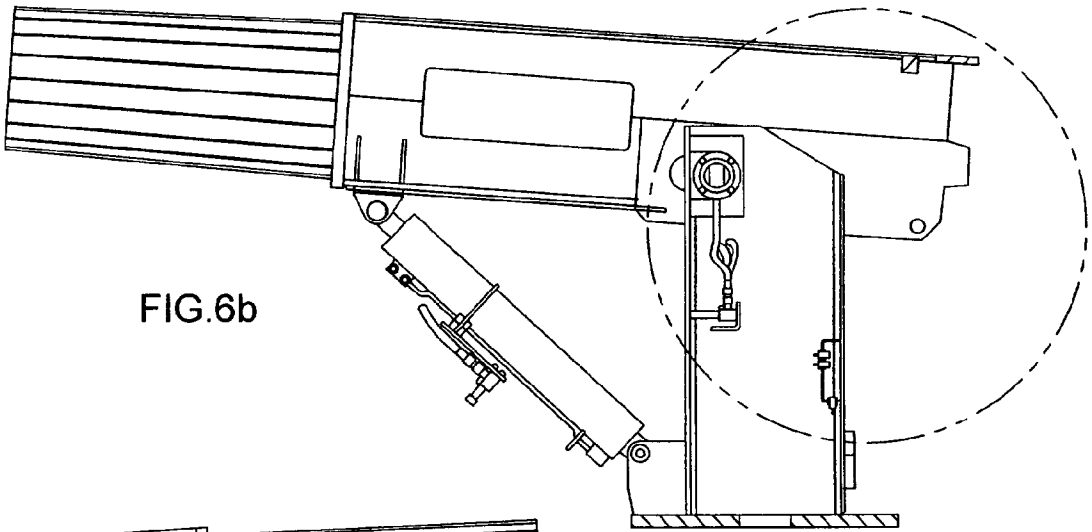
Figure 6D:
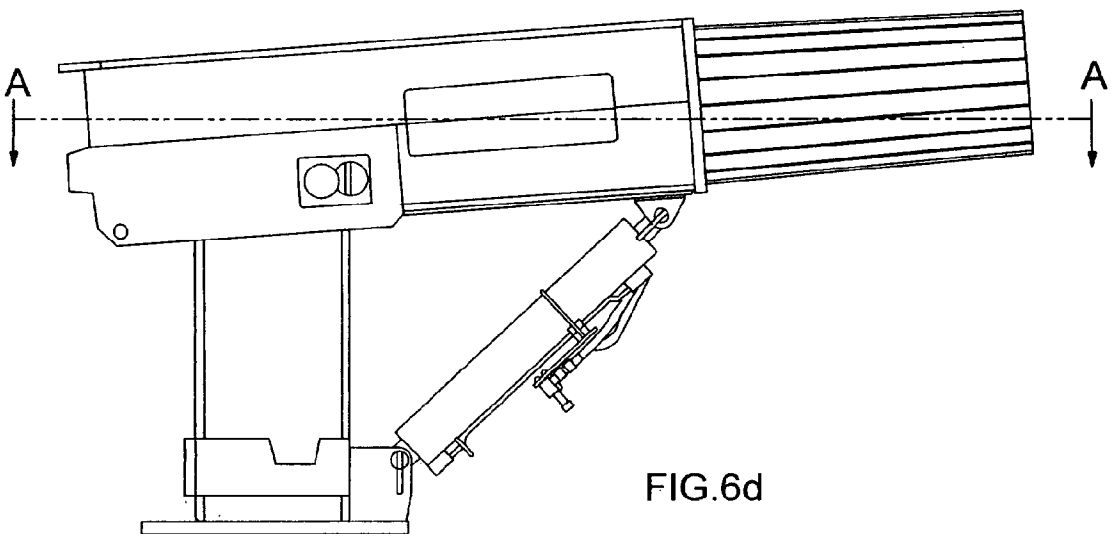
Figure 6E:
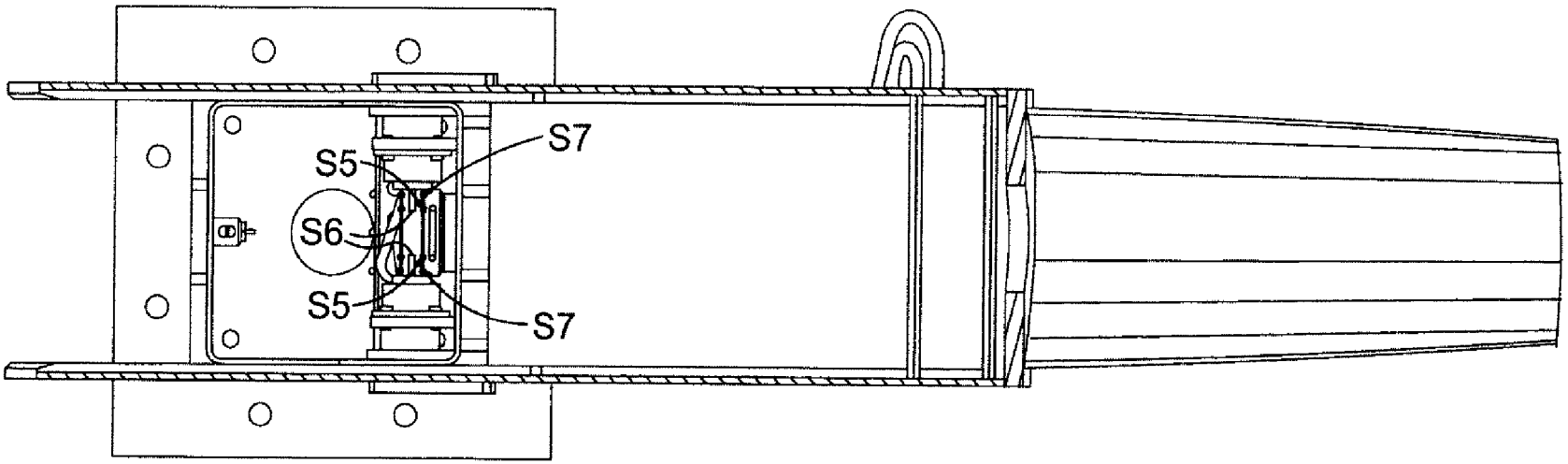

As can be seen from FIGS. 2*e* and 3*e*, a pair of cam rams 18 are located aligned on the horizontal pivot axis of the mast 10.

Each of the cam rams 18 is moveable between a first, locking position as shown in FIGS. 2*d* and 2*e*, in which the cam plate 24 of the cam ram 18 is engaged in the upper cylindrical portion of the aperture 28 in the chock plate 26, and an intermediate position, which can be seem most clearly in FIG. 3*e*, in which the cam plate 24 of the cam ram 18 projects from the sidewall 30 of upper base portion 6 and the shaft 22 of the cam ram 18 extends through the aperture 28.

The operation of the system will now be described with reference to FIGS. 2 to 6 of the accompanying drawings.

The normal operation position of the mast 10 is shown in FIGS. 2*a* to 2*e*. In this position, the mast 10 is raised, locked by means of the cam plate 24 in engagement with the upper circular portion of the aperture 28 in the chock plate 26. The vertical alignment of the mast 10 is checked by sensor S2 and the extension of the lift rams 36 is sensed by sensors S1, S2 and S4. The control system then extends the cam rams 18 until full extension is confirmed by the sensors S6, S7.

The position of the mast 10 is now as shown in FIGS. 3*a* to 3*e*, i.e., raised, docked and unlocked. The control system then extends the lift rams 36 so as to lift the upper mast portion 2 and the upper base portion 6 relative to the lower base portion 8 and to disengage the docking latch 12 from the notch 14. The sensors S1 and S4 confirm that the disengagement is complete.

The position of the mast 10 is now as shown in FIGS. 4*a* to 4*e*, i.e., raised, undocked and unlocked. The control system then retracts the cam rams 18 and hence the cam plates 24 into engagement with the lower circular portion of the aperture 28 and the sensors S5 and S6 confirm that the retraction is complete.

The position of the mast 10 is now as shown in FIGS. 5*a* to 5*e*, i.e., raised, undocked and locked. The control system then retracts the lift rams 36, and the mast is lowered about the horizontal pivot axis 16 until the ground proximity sensor S8 senses a predetermined proximity to the ground, and retraction of the lift rams 36 is terminated.

The mast 60 is now in the position shown in FIGS. 6*a* to 6*e*, i.e., lowered, undocked and locked.

After the required repair or maintenance work has been carried out, the lowering sequence is repeated in reverse, so as to return the mast 10 to the position shown in FIGS. 2*a* to 2*e*.

The invention claimed is:

1. An arrangement for the raising and lowering of a mast, which comprises: an upper mast portion and a base, which upper mast portion is rotatable about a horizontal pivot axis, located in the base of the mast, which arrangement comprises:

(i) a docking latch for restraining the upper mast portion against rotation;

(ii) mounting brackets for attaching lift rams for driving the docking latch between a first engaged configuration wherein the upper mast portion is restrained against rotation and a second disengaged configuration wherein the upper mast portion is free to rotate and (iii) a lock selectable via an intermediate unlocked configuration, in which a cam plate thereof is disengaged with a figure of eight shaped aperture, between a first locked configuration wherein the docking latch is engaged and said cam plate is engaged in an upper part of said figure of eight shaped aperture, and a second unlocked configuration wherein the docking latch is disengaged and said cam plate is engaged in an lower part of said figure of eight shaped aperture, (iv) characterized in that one or more sensors for sensing the vertical alignment of the upper mast portion and/or the configuration of the lock, and/or the configuration of the docking latch and/or the proximity of the upper mast portion to the ground is also provided; and the lock is controllable remotely to allow automatic operation of the raising and lowering sequence.

2. An arrangement according to claim 1 which further comprises drive means for driving the docking means, attached to the attachment means.

3. An arrangement according to claim 2 in which the drive means comprises hydraulic rams.

4. An arrangement according to any of claim 1 in which the locking means is provided with drive means.

5. An arrangement according to claim 4 in which the drive means comprises hydraulic rams.

6. An arrangement according to claim 1 in which the locking means is located in the base of the mast and provides the horizontal pivot axis about which the upper mast portion is rotatable.

* * * * *